United States Patent [19]

Bergh

[11] 4,377,922

[45] * Mar. 29, 1983

[54] PORTABLE APPARATUS FOR TREATING SURFACES

[75] Inventor: John C. Bergh, Elkhart, Ind.

[73] Assignee: Wheelabrator-Frye Inc., Hampton, N.H.

[ * ] Notice: The portion of the term of this patent subsequent to Mar. 29, 2000, has been disclaimed.

[21] Appl. No.: 654,078

[22] Filed: Feb. 2, 1976

[51] Int. Cl.[3] ..... B24C 9/00

[52] U.S. Cl. ..... 51/424; 51/428

[58] Field of Search ..... 51/8, 8 BR, 9, 9 M, 51/11, 12, 263, 424, 428, 429, 431, 432; 114/222, 224

[56] References Cited

U.S. PATENT DOCUMENTS

| | | | |
|---|---|---|---|
| 3,034,262 | 5/1962 | Pawlson | 51/9 M |
| 3,385,006 | 5/1968 | Miller et al. | 51/8 |
| 3,877,175 | 4/1975 | Snyder | 51/9 M |
| 3,900,968 | 8/1973 | Shigyo | 51/9 M X |
| 3,900,969 | 8/1975 | Diehn | 51/9 M |

*Primary Examiner*—James G. Smith

*Attorney, Agent, or Firm*—McDougall, Hersh & Scott

[57] ABSTRACT

A portable apparatus for treatment of surfaces, preferably horizontal, comprising a centrifugal wheel for projecting abrasive particles onto the surface at an angle within the range of 30° to 80° with the surface, a feed hopper for supplying abrasive particles to the wheel, a rebound corridor of decreasing cross-section extending angularly upwardly and into which the abrasive particles rebound upon striking the surface and means for returning abrasive particles rebounding through the corridor to the hopper.

6 Claims, 3 Drawing Figures

PORTABLE APPARATUS FOR TREATING SURFACES

This invention relates to a device for treatment of surfaces with particulate material thrown at high velocity onto the surface and it relates more particularly to a portable device which makes use of one or more airless wheels having radially extending blades for throwing, by centrifugal force, particulate material such as steel shot, grit, or abrasive particles against the surface for cleaning, abrading, or other surface treatment.

Recovery for re-use of abrasive or other particulate material is essential to the successful operation of the device, otherwise the cost of particulate material or abrasive becomes excessive, the means for supplying of the large volumes of abrasive material imposes a similar problem of size and weight, and the means for disposal of spent abrasive material increases the problem of size and weight.

Recovery of particulate material and abrasives entails the problems of removal of the particulate material and abrasive from the surface after they have served their purpose, separating re-usable particulate material and abrasive from the dust, dirt and fines picked up from the surface, and returning the cleaned particulate material or abrasive for recycle to the centrifugal blasting wheel for re-use in surface treatment.

Such recovery, cleaning and recycle of cleaned particulate material and abrasive must be embodied in a unit with the centrifugal wheels and housings for confinement of the abrasive particles thrown from the wheels if the unit is intended for use as a portable surface cleaning or treating device.

Present surface treatment devices of the type described, especially for the treatment of horizontal surfaces, such as floors, ships' decks, roads, runways and the like, are very large and difficult to maneuver in relatively small areas. A great deal of the length and weight is taken up by the recovery, cleaning and recycle system for the used particulate material or abrasive.

It is an object of this invention to provide a portable surface treating device of the type described which is of a size and weight to be easily maneuverable over the surface to be cleaned or otherwise treated, in which means are provided for recovery of the re-usable abrasive or other particulate material, in which the recovered abrasive or particulate material is cleaned and recycled as feed to the centrifugal throwing wheel in a simple and efficient manner which requires a minimum of space and additional equipment, and in which the abrasive or other particulate material is substantially completely removed from the cleaned or treated surfaces thereby to minimize the loss of material, and the amount of additional cleaning required to remove the dust and residue from the cleaned or treated surfaces.

These and other objects and advantages of this invention will hereinafter appear and for purposes of illustration, but not of limitation, an embodiment of the invention is shown in the accompanying drawings, in which FIG. 1 is a schematic sectional elevational view showing the essential elements of a portable apparatus embodying the features of this invention for cleaning a floor, ship's deck, or other horizontally disposed surface;

Figure 1:
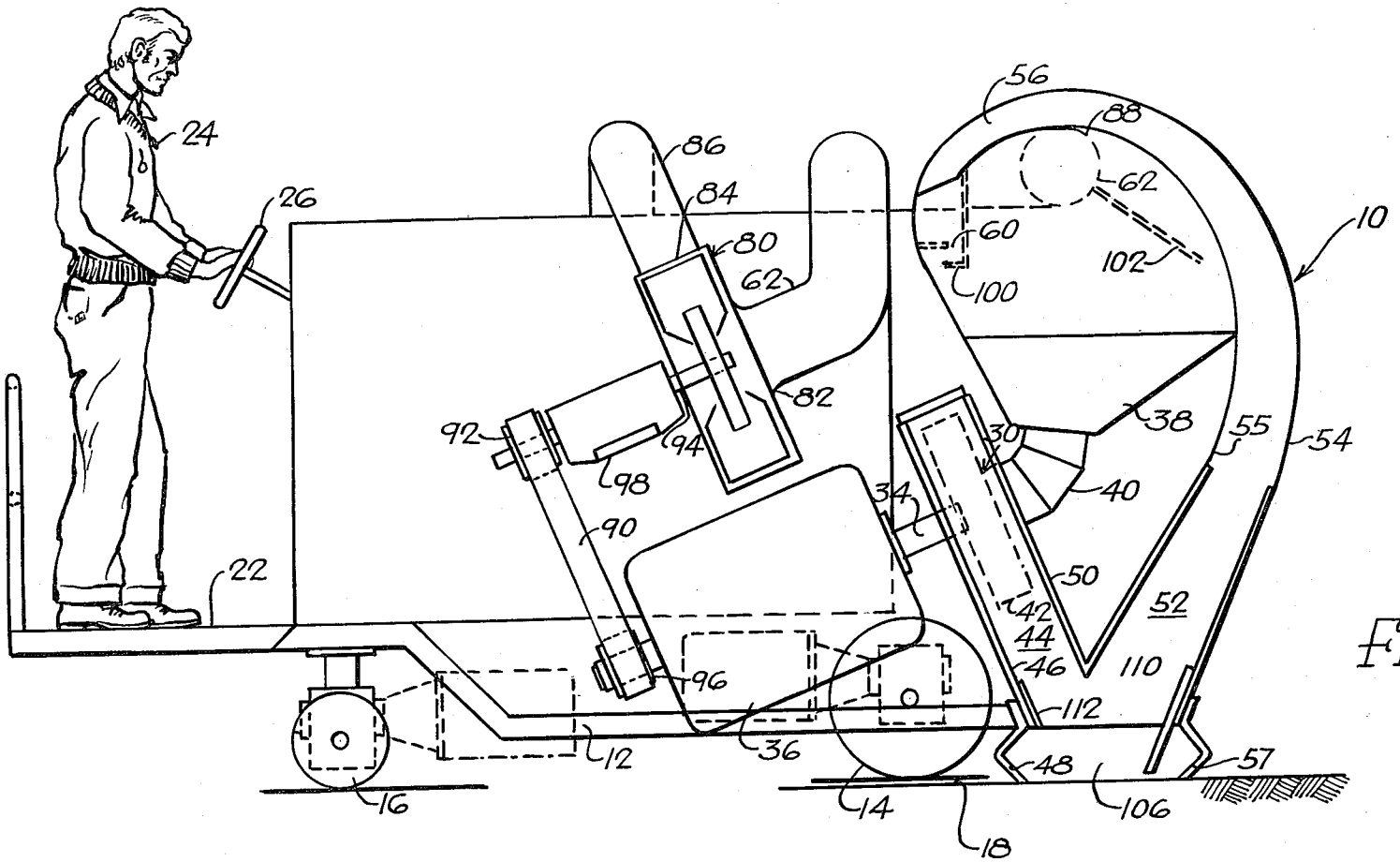
Figure 2:
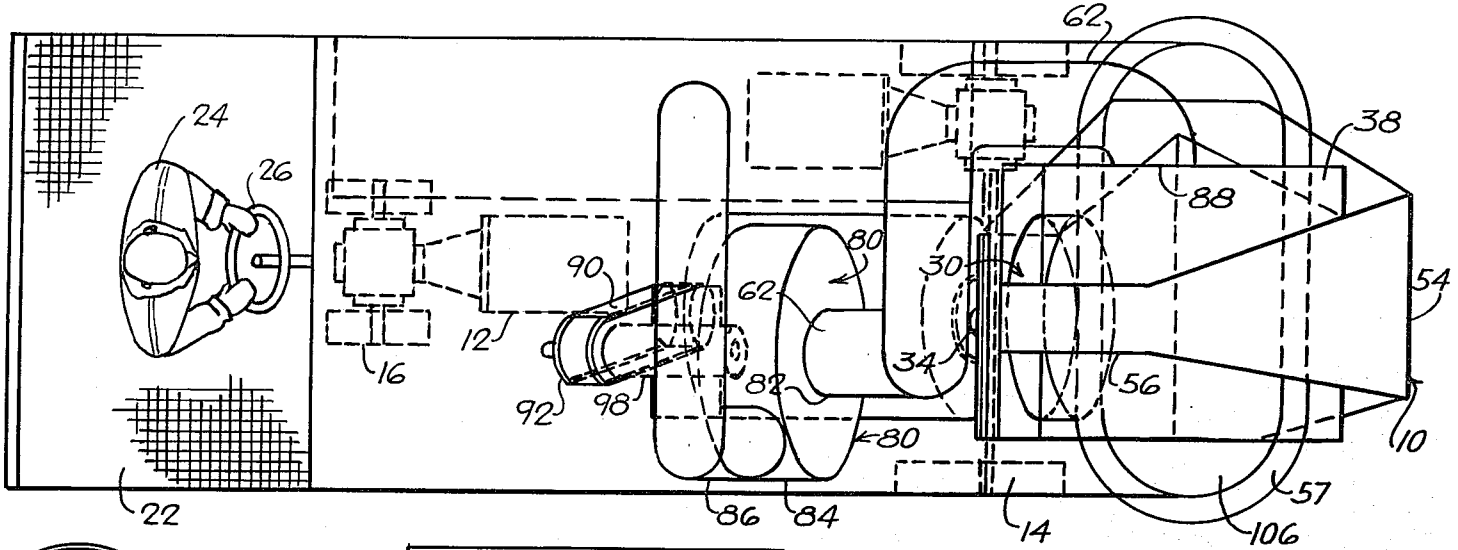
FIG. 2 is a top view of the apparatus shown in FIG. 1.

The invention will be described with reference to an apparatus for cleaning a horizontally disposed, relatively flat surface, such as a floor, ship's deck, airport runway, street and the like, but it will be understood that the apparatus to be described has application also for the treatment of surfaces other than flat and other than horizontal, such for example as a rolling surface, inclined surface and even a vertical surface.

While the invention will hereinafter be described with reference to the use of hard abrasive particles for cleaning such surfaces, it will be understood that the apparatus of this invention has application for the treatment of surfaces with other particulate material for use in cleaning surfaces, removal of surface finishes, hardening surfaces as by peening or impacting, and for providing certain finishes to a metal, plastic, wooden and the like surface. The type of surface treatment or finish depends somewhat upon the type of particulate material projected onto the surface such as steel shot, steel grit, metal abrasive, sand for surface cleaning, or softer materials such as particulate organic materials in the form of nut shells, nut seeds, wooden or plastic particles and the like for surface finishing, hereinafter collectively referred to as abrasive particles.

Referring now to the drawings, illustration is made of an apparatus 10 which includes a rigid frame 12 mounted on wheels 14, one of which is in the form of a caster wheel 16 for enabling movement of the apparatus in various directions over the surface 18 to be treated. The apparatus may be adapted for movement by hand, in which event handle bars 20 are provided to extend rearwardly from the frame, or the apparatus may be powered for movement over the surface, as by means of an electrical motor drive (not shown), in which event a platform 22 is provided to extend rearwardly from the frame and on which the operator 24 rides, with steering means 26 for maneuvering the apparatus over the surface to be treated.

The apparatus 10 is provided with one or more centrifugal wheels 30 enclosed within a protective housing 12. The wheel 30 is generally referred to as a centrifugal blasing wheel, of the type well known to the trade, and marketed by Wheelabrator-Frye Inc. of Mishawaka, Ind., under the name WHEELABRATOR. The wheel is rotated at high speed on an axle 34 driven by an electrical motor 36. Instead of a direct motor drive, rotational movement at high speed can be imparted to the wheel by means of a belt drive which interconnects a pulley on the end of the axle with a motor driven sheave offset from the wheel axis.

Abrasive particles are fed from a supply hopper 38 through a feed spout 40 to a cage in the center of the wheel. The cage dispenses the abrasive particles onto the inner end portion of the blades 42 which extend radially outwardly in circumferentially spaced relation from the hub whereby, in response to rotational movement of the wheel, the abrasive particles are displaced radially outwardly over the surfaces of the blades and thrown with high centrifugal force from the ends of the blades in a direction controlled by the cage. The rate of flow of particulate material is controlled by a control valve in the feed system.

As illustrated in FIG. 1, the wheel axle is inclined so that the abrasive particles will be thrown from the blades angularly downwardly through a similarly inclined blast corridor 44 onto the surface 18. The cleaning efficiency and rebound of the abrasive particles, for best recovery, is somewhat dependent upon the angle of inclination at which the abrasive particles strike the surface which angle corresponds to 90° minus the angle of inclination that the wheel axle makes with the horizontal. The angle of inclination that the wheel axle makes with the horizontal should be less than 60° and not less than 10° so that the angle at which the abrasive particles strike the surface will not be less than 30° nor greater than 80° and preferably within the range of 45° to 65°.

The bottom wall 46 of the blast corridor 44 terminates a short distance above the surface 18 and is provided with a resilient skirt 48 to extend therefrom substantially into engagement with the surface 18 to prevent abrasive particles from ricocheting from the blast housing, while also blocking off the interior of the blast area. The upper wall 50 of the blast corridor terminates at a higher level to define the entrant opening into the rebound corridor 52.

Advantage is taken of the kinetic energy imparted to the abrasive particles striking the surface whereby the abrasive particles rebound from the surface into the upwardly inclined rebound corridor at an angle which is somewhat less than the reflective angle at which the abrasive particles strike the surface.

In the preferred practice of this invention, the outer wall 54 of the rebound corridor 52 extends curvilinearly upwardly to define a curvilinear rebound corridor which rises to a level above the hopper 38 and terminates in an end portion 56 which extends angularly downwardly, preferably in the direction toward the hopper 38, whereby the particulate material travels substantially horizontally over a bump at the top during passage through the rebound corridor. The outer wall 54 terminates at its lower end a short distance above the surface 18 and from which a resilient skirt 57 depends, in a manner similar to skirt 48.

A majority of the rebound abrasive particles will possess sufficient kinetic energy whereby further assistance is not required to carry them upwardly through the curvilinear rebound corridor into the end portion 56 for subsequent gravitational flow through an air wash separation unit 60, for removal of dust and fines through duct 62 to a dust collector D, while the cleaned abrasive particles fall gravitationally from the air wash into the supply hopper 38 for recycle to the wheel 30.

An important concept of this invention resides in the configuration and size of the rebound corridor whereby utilization is made of air flow to assist the kinetic energy in carrying the abrasive particles through the rebound corridor so that substantially all of the abrasive particles, dust and fines traverse the rebound corridor to at least the end portion 56, at which point gravitational forces become effective to carry the abrasive particles through the air wash 60 and return to the supply chamber 38.

For this purpose, the walls of the curvilinear rebound corridor converge gradually substantially uniformly from the entrance at the lower end toward the outlet at the upper end whereby the cross-section of the corridor decreases gradually from the inlet substantially throughout the length of the rebound corridor. Such gradual diminishing cross-section has the effect of increasing the rate of flow of air through the corridor by an amount which corresponds substantially inversely to the square of the cross-section of the corridor. Thus the linear velocity of the air stream increases rapidly as it flows upwardly through the rebound corridor whereby the increased velocity in the upper end portion of the corridor is sufficient, in addition to the kinetic energy, to carry the particular materials for complete traverse of the rebound corridor.

While the decrease in cross-section may continue to the end of the corridor, it is not necessary to effect such decrease beyond the hump in the corridor since gravitational force thereafter becomes effective to assist in the continued flow of the particulate material to the end of the corridor for passage through the air wash and return of the cleaned abrasive particles to the hopper.

Figure 3:
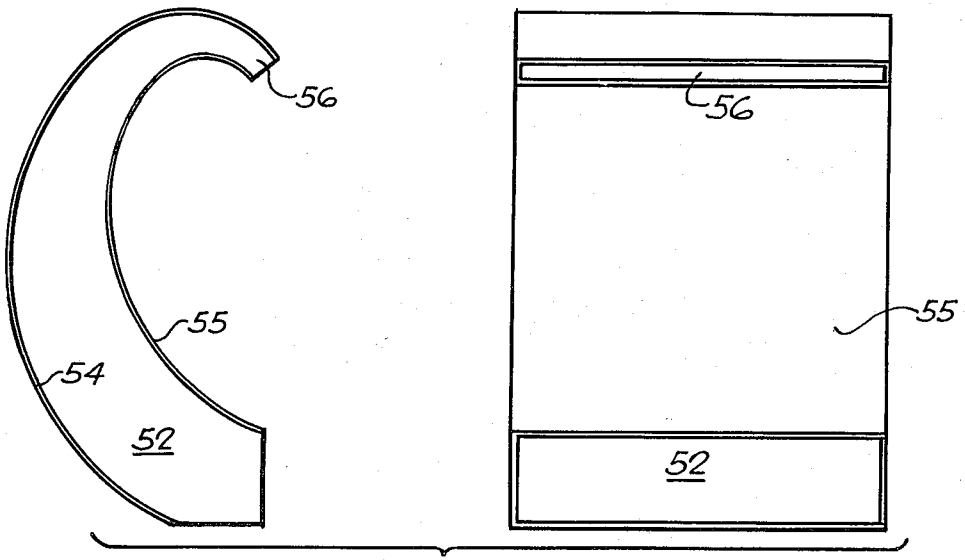
FIG. 3 is an elevational plan view of the rebound corridor.

For purposes of illustration, but not by way of limitation, the curvature and dimensional characteristics of a rebound corridor representative of commercial practice are given in FIG. 3 in which the rebound corridor is shown as decreasing in radius of curvature with the inner wall 55 decreasing at a rate more rapid than the outer wall 54. It will be understood that the size of the rebound corridor can vary, depending somewhat upon the capacity of the apparatus.

Air flow through the rebound corridor is induced by a blower 80 mounted for rotational movement within a fan housing having an inlet 82 at the center and an outlet 84 at the periphery which communicates through duct 86 with a dust separator D. Suitable dust separators are well known in the industry as represented by the "dust tube" marketed by Wheelabrator-Frye Inc., supra. Other separators such as a cyclone separator and the like can be used. The inlet to the blower communicates through duct 62 with an outlet 88 at the top of the supply hopper beyond the air wash 60 whereby air is drawn into the rebound corridor and upwardly, with increasing velocity, through the rebound corridor and then across the air wash to the outlet for return to the dust collector.

The blower 80 may be operated by a separate motor drive or, as illustrated in the drawings, the driving force may be transmitted from the same motor 36 for the blasting wheel via an endless driving belt 90 which interconnects a pulley 92 on the end of the fan shaft 94 with a sheave 96 on the end of the motor axle, with the fan shaft 94 supported for rotational movement by a bearing block 98.

Air is drawn into the blast area through the wheel housing and from the atmosphere surrounding the skirts 48 and 57, with such velocity as to induce entrainment of dust, dirt and abrasive particles, thereby to leave little, if any, dust and abrasive particles on the surface 18. Additional air for the air wash can be drawn by the blower through inlets in crosswise alignment of the air wash for flow through the curtain of particulate material falling from the ledge 100 to wash the fines and dust from the re-usable particulate material. A baffle 102 extends from the outlet 88 towards the wall of the hopper opposite the air wash 60 to insure full release of reusable particulate material that otherwise might be carried with the air stream to the dust collector.

The few abrasive particles which do not traverse the rebound corridor fall back to the surface and pass under the seal 56 from the blast chamber. These particles are picked up by a trailing auxiliary pick-up unit, such as a vacuum cleaner, magnetic frum, rotating brush, or the like. It will be understood that the power requirements for operating such auxiliary unit to pick up the small amount of abrasive particles remaining as a residual on the surface 18 is many times smaller than the power that would otherwise be required fully to recover the abrasive particles within the blast unit itself.

The great majority of the abrasive particles, entrained dust and fines, rebound with sufficient kinetic energy to pass through the rebound corridor for cleaning and return to the supply hopper. As a result, it is possible markedly to increase the recovery capability of the device without placing great reliance on auxiliary recovery systems which can therefore be made to operate simply and in a very efficient manner and without the need to take up much space or energy for substantially complete recovery of the abrasive particles.

In operation, the abrasive particles are thrown from the wheel blades in a somewhat rectangular pattern that spreads substantially to cover the exit opening from the blast corridor. Thus the wall portion adjacent the exit opening from the blast corridor is preferably lined with replaceable wear plates 110 and 112 to prevent abrasive wear on the walls of the housing. The corridors are enclosed by side walls 104 from which resilient skirts 106 extend into engagement with the surface to define, with the skirts 48 and 57, a resilient seal about the blast area. The cleaning effect is derived, at least in part, by the beat of the abrasive particles thrown sequentially by the radially spaced blades of the wheel, while the latter is rotating at high speed.

Instead of making use of gravity feed from the hopper to the wheel, use can be made of other systems for feeding particulate material to the wheel, such as a pneumatic feed, screw feed or other means for positive displacement of abrasive material in the desired amounts. Under such circumstances, it is not essential to have the rebound corridor rise to a certain level, although it is preferred that the rebound corridor terminate, at its exit end, in a downward incline so as to be able to take advantage of gravitational forces for continued processing of the recovered particles.

From the foregoing, it will be apparent that an apparatus is provided for the treatment of surfaces in which utilization is made of kinetic energy resident in the abrasive particles and which also harnesses entrainment in air traveling at increasing velocity through the rebound corridor to enable recovery of the abrasive particles in an efficient and economical manner whereby size, weight and cost of the unit can be greatly reduced, while providing greater maneuverability, by hand or by power operated means, over the surface to be treated.

It will be understood that changes may be made in the details of construction, arrangement and operation without departing from the spirit of the invention, especially as defined in the following claims.

I claim:

1. In an abrasive throwing machine comprising an enclosure having an opening therein, sealing means around the periphery of said opening in said enclosure to contact a surface to be treated and to retard the escape of spent abrasive from said enclosure, means within said enclosure for projecting abrasive particles along an incident path through said opening to a blast zone on said surface and from the blast zone along an upward rebound path, said projecting means being oriented to establish both said incident path and said rebound path at acute angles relative to said surface, and means for returning spent abrasive along a spent abrasive recycle path to said projecting means, the improvement wherein said return means comprises a substantially unobstructed, elongated, recirculating chamber means connecting said blast zone with said projecting means for returning spent abrasive from the blast zone to the projecting means for re-use, said chamber means diminishing in cross-section from said blast zone to said projecting means, and means for providing a stream of fluid into said blast zone, wherein the energy of said rebounding particles and the force exerted on said particles by said fluid are together sufficient to carry said spent abrasive along said recycle path to said projecting means.

2. In an abrasive throwing machine comprising an enclosure having an opening therein, means around the periphery of the opening in said enclosure extending towards the surface to be treated to retard the escape of spent abrasive from said enclosure, means within said enclosure for projecting abrasive particles along an incident path through said opening onto the surface and from the opening along a rebound path which is substantially along a mirror angle of said incident path, said projecting means being oriented to establish said incident path at an acute angle relative to the surface, and means for returning spent abrasive along a spent abrasive recycle path to said projecting means, the improvement wherein the rebound path is defined by a chamber within the enclosure which gradually diminishes in cross section substantially throughout its length from adjacent the opening.

3. An apparatus as claimed in claim 2 in which the incident angle is within the range of 30° to 80°.

4. An apparatus as claimed in claim 2 which includes a hopper for feeding abrasive particles to the projecting means.

5. An apparatus as claimed in claim 2 in which the opening and the surface which underlies the opening are substantially horizontally disposed and the abrasive particles are projected downwardly onto the surface and rebound upward from the surface.

6. An apparatus as claimed in claim 5 which includes an air wash between the end of the rebound path and the hopper for the removal of dust and fines from the abrasive particles returned to the hopper.

* * * * *